United States Patent [19]

Megowen et al.

[11] 4,065,018

[45] Dec. 27, 1977

[54] CLOSURE MEANS AND METHOD

[75] Inventors: William J. Megowen, Carlisle; Harvey M. Cohen, Needham, both of Mass.

[73] Assignee: William J. Megowen, Carlisle, Mass.

[21] Appl. No.: 710,412

[22] Filed: Aug. 2, 1976

[51] Int. Cl.[2] ..... B65D 51/26; B65D 53/00

[52] U.S. Cl. ..... 215/231; 215/270; 215/341; 215/355; 215/364; 53/37

[58] Field of Search ..... 215/260, 261, 270, 358, 215/231, 354, 364, 341, 355; 220/202, 203, 204; 53/37 R

[56] References Cited

U.S. PATENT DOCUMENTS

| | | | |
|---|---|---|---|
| 2,603,218 | 7/1952 | Rane | 215/247 |
| 3,733,771 | 5/1973 | Megowen | 53/37 |

FOREIGN PATENT DOCUMENTS

| | | | |
|---|---|---|---|
| 637,378 | 3/1962 | Italy | 215/358 |

*Primary Examiner*—William Price
*Assistant Examiner*—Joseph M. Moy
*Attorney, Agent, or Firm*—Dike, Bronstein, Roberts, Cushman & Pfund

[57] ABSTRACT

An improved closure for fragile containers substantially filled with a gassy liquid, said closure comprising a combination of a cap for the container and a volumetric member partially within said cap and partially extending into the interior of the container. The volumetric member displaces and contains free gas generated by the gassy liquid thereby substantially reducing or completely eliminating the explosive potential of the container. The volumetric member is characterized by means that facilitate drainage of the gassy liquid should the liquid enter the member such as by expansion caused by elevated temperatures or inversion or shaking of the container.

15 Claims, 4 Drawing Figures

CLOSURE MEANS AND METHOD

BACKGROUND OF THE INVENTION

1. Field of the Invention

This invention relates to a closure for fragile containers and more particularly, to a closure for fragile containers incompletely filled with a gassy liquid.

2. Description of the Prior Art

Modern carbonated beverages containing dissolved carbon dioxide are marketed in sealed fragile containers — i.e., glass containers, which are substantially but incompletely filled with the gassy beverage and which have a space over the beverage, known as the head space, containing free gas under pressure. The free gas in the head space, typically an admixture of air and carbon dioxide, is a source of danger because, upon fracture of the container, the gas under pressure propels fragments of a broken container at high velocity thereby frequently causing injury to those in the vicinity of the container. In addition, the pressure of the free gas in the head space exerts pressure upon the container cap. This pressure can cause propulsion of the cap at a high speed when the container is stored or initially loosened during unsealing again creating an inherently dangerous situation. Both this phenomenon, known as "cap blow-off" particularly applicable to that portion of the beverage industry using twist-off cap packaging, and the propulsion of fragments upon fracture of the container, present an ever increasing problem to the beverage industry.

The above danger is increased in the summer or in hotter climates due to increased pressure of the free gas in the head space, partly due to the decreased solubility of the carbon dioxide at the elevated temperature. Thus, the danger is greatest when containers filled with carbonated beverages are used in the greatest volume.

A seemingly obvious expedient for avoiding the above problems would be to completely fill the fragile container with liquid thereby eliminating space for collection of pressurized free gas. However, this expedient is not possible since liquid thermal expansion resulting from heating would burst the container. Recognizing the inappropriateness of this technique, the art has focused its attention on three alternative methods to reduce the dangers inherent to container breakage.

The first alternative method is directed solely to encasing the fragile container by coating the entire container surface with a plastic coating. Such a plastic coating, exemplified by Shatterguard and Surlyn, (registered trademarks of Thacher Glass Company and E. I. duPont de Nemours Company, respectively) afford a good surface for handling and to some extent, reduce scratching of the surface of the container, which scratching can lead to fracture. The coating also dampens the explosive velocity of propelled container fragments. However, this method substantially increases the cost of the container, the coating exhibits adverse behavior on return so as to prohibit container refilling and reuse, and the method neglects the danger inherent in the existence of a substantial quantity of pressurized free gas within the head space of the container and hence, does not reduce the danger of cap blow-off.

The second safety method, not in general use, is characterized by a closure means designed to relieve temperature induced free gas pressure buildup inside the head space of the container. Such closures are illustrated by flexible membranes or bellows which inflate outwardly as pressure builds up. This method does not attack the basic safety problem created by the mere existence of a significant quantity of pressurized free gas in a fragile container and does not substantially reduce explosive breakage. Moreover, an inflated and outwardly extending closure creates practical problems in container handling, storage and leakage.

The third and perhaps technically, the most feasible of the prior art methods, comprises a closure means characterized by a combination of a cap and shape retaining volumetric member extending into the interior of the fragile container. The volumetric member is provided with a small orifice in open communication with the interior of the container. Such a closure is described in U.S. Pat. No. 3,733,771, incorporated herein by reference. In use, the fragile container is filled with the gassy liquid and the volumetric member is inserted into the opening of the container. It is of a volume either substantially equivalent to or somewhat less than the volume of the head space within the container such that the volumetric member displaces all or most of the free gas within the head space. The container is then sealed with the cap. Thus most of the gas under pressure in the container is contained within the volumetric member. If the temperature of the gassy liquid increases in sotrage resulting in liberation of carbon dioxide under pressure, the gas thus liberated is forced through the orifice into the volumetric member where it also becomes entrapped within the member. Upon fracture of the fragile container, the gas entrapped within the volumetric member can only slowly leak through the orifice and consequently, the bulk of the free gas is not available to contribute to the explosive force and propel fragments of the container. Hence the explosive potential of the container is substantially reduced, or even entirely eliminated, as little free gas is present in the container outside of the volumetric member, and the gas within the volumetric member is not available to contribute to the explosive potential as it is entrapped within the confines of the volumetric member.

The above closure means overcomes many of the problems of the prior art but is not optimal as it does suffer several limitations. For example, if liquid enters the volumetric member as a result of an increase in liquid volume caused by thermal expansion, or through shaking or inversion of the container, it too becomes entrapped within the volumetric member due to an inability to drain therefrom due, in part, to an unequal pressure between the volumetric member and the interior of the container and in part due to surface tension effects. Due to displacement of liquid from within the container to the volumetric member, there is an increased volume of space within the container in which gas under pressure can collect and a decreased volume of space within the volumetric member wherein free gas can be entrapped. Hence, free gas under pressure is present within the container external to the volumetric member thus again increasing the explosive potential of the container.

The above problem is not overcome by the simple provision of a second orifice in the volumetric member (which would be expected to permit pressure equalization between the interior of the volumetric member and the container) because a meniscus forms between the wall of the volumetric member and the container that prevents pressure equalization, and further, because of surface tension effects, the liquid may not drain adequately through a small orifice.

Further, the volumetric member, though reducing the volume of gas available to propel container fragments upon breakage, and though lessening the danger of cap blow-off upon unsealing of the cap, compared to the current state of the art, does not eliminate the danger of cap blow-off because the gas entrapped within the volumetric member is in direct contact with the cap.

STATEMENT OF THE INVENTION

It is an object of this invention to provide an improved closure for fragile containers filled with gassy liquids, said closure substantially decreasing the volume of free gas within the container thereby decreasing the explosive potential of the container.

It is another object of this invention to provide a closure combination for a fragile container substantially filled with a gassy liquid, said combination comprising a cap and a volumetric member having means permitting rapid drainage of liquid from within the member.

It is a further object of this invention to provide a closure means for fragile containers substantially filled with gassy liquids which closure substantially eliminates the hazard of cap blow-off.

The invention comprises a container substantially, but incompletely filled with a gassy liquid, said container sealed with a closure that is a combination of a cap and a volumetric member within the cap and extending into the container. The volumetric member is hollow and has at least two holes located on its surface in open communication with the interior of the container. The holes are of a size and are located in the member so as to permit pressure equalization between the volumetric member and the interior of the container thus permitting liquid drainage from within the member.

In a most preferred embodiment of the invention, means are also provided to prevent liquid meniscus formation between the wall of the container adjacent to the volumetric member and the wall of the member as such a meniscus may interfere with pressure equalization between the member and the container thus retarding or preventing liquid drainage.

In a further embodiment of the invention, means are included between the cap-volumetric member combination that prevent "cap blow-off". Means of this nature can take a variety of forms such as a membrane separating the gas within the volumetric member from the cap.

The closure of this invention effectively contains gas liberated from the gassy liquid while providing rapid drainage of liquid from the member that might otherwise be contained therein with the gas. As a result thereof, the explosive potential of the container is substantially reduced or entirely eliminated thus avoiding the problems of the prior art described above.

DESCRIPTION OF THE PREFERRED EMBODIMENTS

Figure 1:
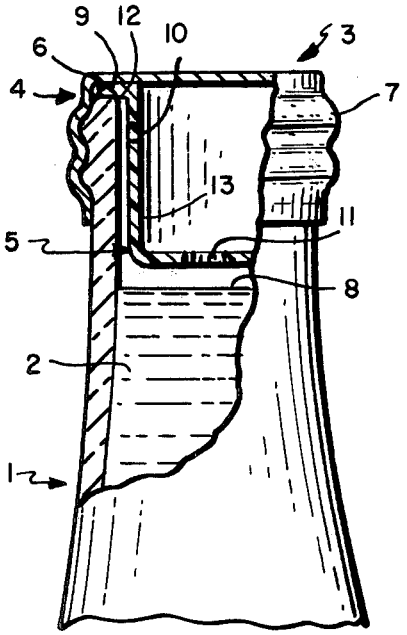
FIG. 1 is a front elevation view, partially in section, of a container partially filled with a carbonated beverage and sealed with the closure of the invention.

With reference to FIG. 1 of the drawings, there is shown a container 1 filled with gassy liquid 2 and sealed with closure 3. Closure 3 comprises a cap 4 and a volumetric member 5. As can be seen from the drawing, the volumetric member extends into container 1 through the inlet thereof 6. The closure 3 tightly seals container 1 by sealing means 7 which in this embodiment comprises matching threads on the cap on the outer surface of the container. The gassy liquid 2 fills the container 1 to level 8 and the distance between level 8 and the top of the container is what would be known as the "head space" in the absence of volumetric member 5. The volumetric member 5 comprises body portion 13, which is provided with top flange 9 having substantially the outside diameter of container 1 at its uppermost surface to prevent the volumetric member 5 from falling into container 1 and also to enhance the seal between container 1 and cap 4. The volumetric member 5 has two orifices in open communication with the interior of container 1, upper orifice 10 and lower orifice 11. The lower orifice 11 permits free gas under pressure to pass into volumetric member 5 and further permits liquid drainage from volumetric member 5 and the combination of the lower orifice 11 and the upper orifice 10 permits pressure equalization between the interior of volumetric member 5 and container 1. As will be discussed in greater detail below, the relative sizes of the two orifices are carefully selected. The lower hole must be sufficiently small so as not to permit too rapid an escape of gas back into the container upon breakage of the container, but not too small so as to interfere with liquid drainage from the member. The side wall of volumetric member 5 is displaced a distance 12 from the adjacent inner wall of container 1. This distance 12 is typical sufficient to prevent meniscus formation between the volumetric member 5 and the container 1.

The volumetric member 5, while not of critical shape, is preferably thin-walled and thimble-shaped dependent in part upon the geometry of the container inlet. The material of which volumetric member 5 is made is not critical but should be hydrophilic, preferably rigid so as not to collapse and of sufficient strength to retain entrapped gasses within it upon fracture of the container though the strength of the material can be less than that of the fragile container and still be sufficient. Typical materials include, without limitation, plastics such as polyethylene, polystyrene, polyurethane; rubbers, both natural and synthetic; thin metals and the like. Polyethylene is a most preferred material. The size and volume of volumetric member 5 is such that most if not all of the space above liquid level 8, the head space, is filled by volumetric member 5 whereby substantially all of the free gas above gassy liquid 2 is purged by insertion of the member 5 into inlet 6. The displacement of free gas results in a corresponding decrease in the potential explosive energy of the container, since any residual free gas in the container and/or any free gas generated by dissolution of carbon dioxide upon increase in temperature of the liquid passes through orifices 10 and 11 where it becomes partially entrapped and therefore unavailable to contribute to an explosive force upon breakage of the container. It is to be understood that while a total elimination of external free gas will reduce the potential explosive energy to almost zero, it is practically impossible to eliminate all such gas and significant reductions in explosive energy at a given temperature can be achieved in proportion to the amount of gas eliminated short of total elimination. It should further be understood that upon breakage of the container, gas will pass from within volumetric member 5 to the interior of the container through the orifices in the member. However, because of the size of orifices 10 and 11, the escape of free gas is at a slow and controlled rate and hence, the escaping gas does not materially contribute to the explosive force.

Figure 2:
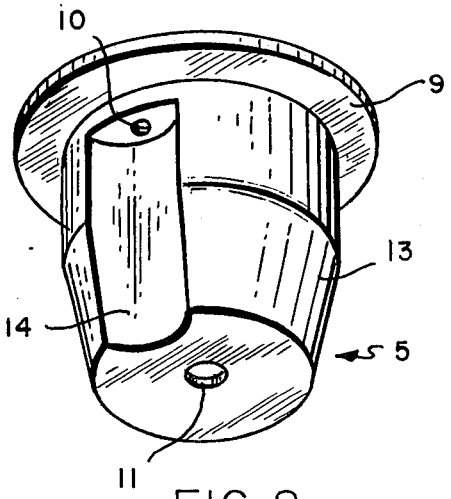
FIG. 2 is an isometric view of a preferred volumetric member in accordance with the invention.

The hollow volumetric member 5 in accordance with a preferred embodiment of the invention is best illustrated in FIG. 2. It comprises a body portion 13 and a top flange 9 to prevent the member from passing completely through the container inlet 6 (FIG. 1) and to aid in tightly sealing the container. As above, the volumetric member has at least two orifices, an upper orifice 10 and a lower orifice 11, the combination of the two being designed to permit pressure equalization between the container 1 (FIG. 1) and the volumetric member 5 and liquid drainage. The lower orifice 11 permits said liquid drainage from within the volumetric member 5 should liquid become entrapped therein such as by thermal expansion of the liquid, inversion of the container, shaking or the like.

Entrapped liquid within volumetric member 5 can defeat the purpose of the invention because the liquid within the volumetric member 5 is removed from container 1. This has two adverse effects. First, the free volume within volumetric member 5 is decreased and there is less volume for entrapment of free gas. Second, the removal of liquid from container 1 will decrease liquid level 8 (FIG. 1) thus increasing the free volume within the container where free gas under pressure can collect. The net result is an increase in gas contained within container 1 and hence, a net increase in the explosive potential of the container.

The size and design of the aforesaid two orifices are determined by balancing two diverse factors. The lower orifice 11 must be of a size sufficient to permit drainage of most of the liquid within volumetric member 5 by gravity and yet must be sufficiently small to prevent gas entrapped within the member from too rapidly or suddenly escaping therefrom to thus substantially contribute to exposive breakage. Conversely, the upper orifice 10 serves to merely afford pressure equalization between the interior of volumetric member 5 and container 1 and therefore may be appreciably smaller in size than orifice 11.

Finally with reference to FIG. 2, there is shown a single channel 14 along the side of volumetric member 5 though it should be understood that more than one channel may be used, for example, four channels may be used spaced from each other by 90° around the circumference of the member. The channel(s) is one of several alternative means for preventing meniscus formation between the side wall of volumetric member 5 and the adjacent wall of container 1. A second alternative would be to simply decrease the width of volumetric member 5 as the primary factor affecting meniscus formation is the distance 12 (FIG. 1) between the side wall of the volumetric member 5 and the adjacent wall of the container with it being recognized that if the distance 12 is sufficiently large, at least at some point around the circumference, the meniscus will not form. Channel 14 is preferred to uniformly reducing the width of volumetric member 5 so as to obtain the maximum decrease in free space within container 1. Meniscus formation of the type described could prevent pressure equalization between the interior of volumetric member 5 and container 1, thereby interfering with free liquid drainage from volumetric member 5. Other alternatives will be discussed below.

The relative size and design of orifices 10 and 11 and channel 14 or an equivalent therefore, is in part dependent upon the surface and wetting characteristics of the material from which both volumetric member 5 and container 1 are constructed and the properties of gassy liquid 2 — i.e., viscosity, surface tension and the like, it being recognized that the more hydrophilic the material of which the member is constructed, the smaller may be the diameter of holes 10 and 11 and the distance 12. With knowledge of the materials involved and the object of the invention as set forth herein, these parameters are readily ascertainable by those skilled in the art.

As an illustration of the above, using a standard glass carbonated beverage bottle, a cola type gassy liquid contained therein and an untreated polyethylene volumetric member, the preferred lower orifice size may be determined by filling the volumetric member with liquid and observing the resultant drainage through the orifice. Following this procedure, it is found that the orifice should have a diameter of about ⅛ inch. As a further guideline only, the distance required between the inner wall of the container and the wall of the volumetric member insert may be of the same dimension. However, as noted above, it is important to note that the clearance need not be uniformly located about the entire circumference of the volumetric member. Instead, only the area in the vicinity of upper orifice 10 need have such clearance. Moreover, design modification around the upper orifice surface such as surface treatment, deformation, puckering or the like, designed to prevent meniscus formation caused by fluid surface tension may significantly reduce the required diameter and/or distance referred to above. Thus, for example, a ⅛ inch channel 14 (FIG. 2) extending from the base of the insert to an upper orifice is sufficient although the remaining distance between the side wall of volumetric member 5 and the adjacent container wall is substantially less than ⅛ inch. The upper orifice on the volumetric member which is used for pressure equalization may be substantially smaller than the lower orifice, preferably having a diameter (if round) of no more than one-half the lower diameter and preferably from one-half to one-tenth the lower orifice diameter.

Figure 3:
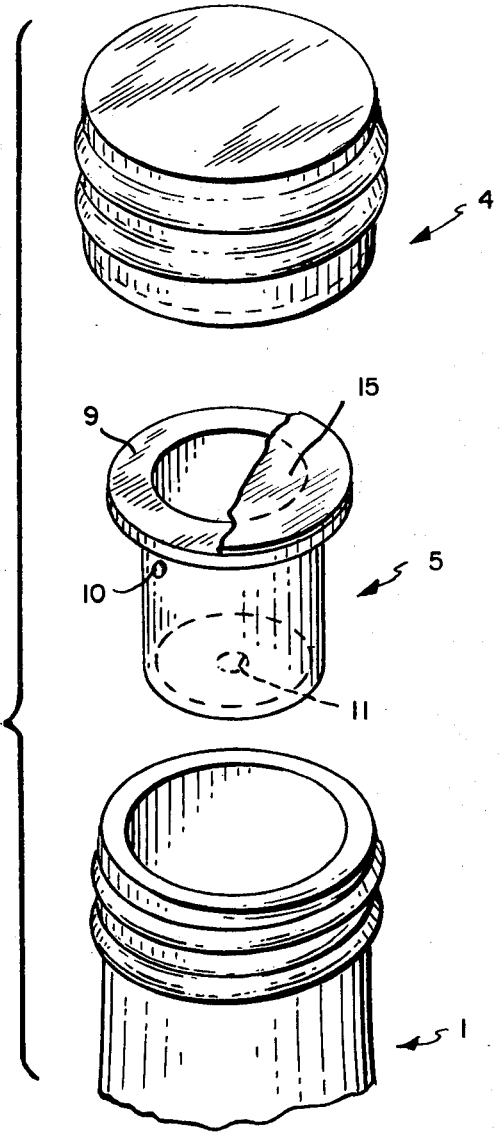
FIG. 3 is an exploded isometric view showing one embodiment of a closure comprising a cap and volumetric member as used to seal a container partially filled with a carbonated beverage.

As an additional embodiment of this invention, free gas entrapped within volumetric member 5 is further restricted so as to preclude its contribution to the explosive propulsion of the cap 4 (cap blow-off). This constraint may take a variety of different forms. For example, with reference to FIG. 3, the top of the volumetric member 5 may be sealed such as with cover layer 15 so as to interpose a non-movable surface between the gas within the volumetric member 5 and the cap 4. Alternatively, with reference to FIG. 4, the volumetric member 5 may be irreversibly joined to the cap 4 to preclude separation and propulsion of the cap. Either embodiment would effectively prevent the gas within the volumetric member 5 from contributing to cap blow-off force. Thus, the potential force of cap blow-off, like the explosive potential of the container itself, would be substantially eliminated, being dependent on the minimal amount of free gas remaining within the container external to the member.

Figure 4:
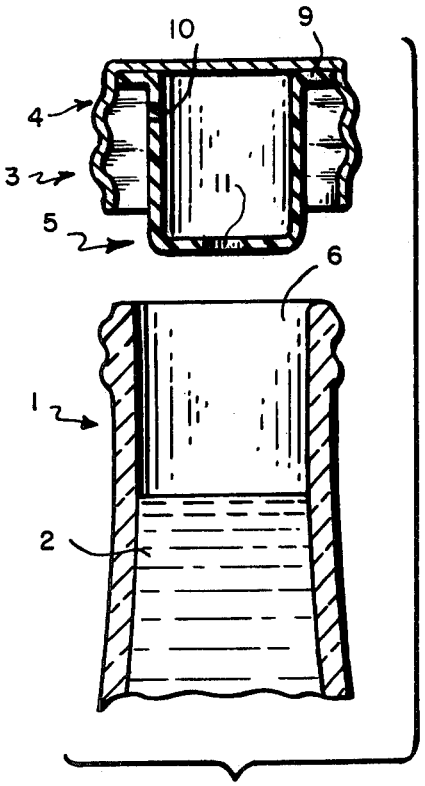
FIG. 4 is an exploded view showing an alternative embodiment of a closure comprising a cap and volumetric member as used to seal a container partially filled with a carbonated beverage.

Again with reference to FIG. 3, the closure 3 is illustrated in two distinct pieces. In FIG. 4, the closure 3 is illustrated in unitary construction. In both, the closure 3 is joined to container 1 subsequent to filling the container substantially, but not entirely full (to liquid level 8 — FIG. 1) with gassy liquid. When the container 1 is filled, volumetric member 5 is inserted into container inlet 6. This displaces most of the free gas as the volumetric member 5 fills most or all of the space above the liquid within container 1. Following insertion of the volumetric member 5 into container inlet 6, the container is sealed. Various means well-known to the art for tightly sealing such containers may be effectively used with this closure system. Exemplifying such means are crown caps, twist-off threaded caps and the like.

We claim:

1. A volumetric member for insertion into a fragile container for gassy liquids, said member having a thimble-like shape and having at least two openings extending through the walls thereof, one opening being above the other, the lower of said openings being of a size sufficient to permit liquid within said member to drain therefrom by gravity and the upper of said openings being smaller than the lower of said openings and of a size sufficient to permit pressure equalization between said member and a sealed fragile container into which said member is inserted.

2. The member of claim 1 where the openings are round and the diameter of the upper opening is from one-tenth to one-half the diameter of the lower opening.

3. A volumetric member for use in a fragile container for gassy liquids, said member having a thimble-like shape and having at least two openings extending through the walls thereof, one above the other, said lower opening being at least substantially twice the size of the upper opening, and at least one channel extending along its side from the upper opening to substantially the bottom of the member, said channel being of a depth sufficient to prevent meniscus formation between the volumetric member and a container into which said volumetric member is inserted.

4. A method for filling and sealing a container for gassy liquids having a single opening, said method comprising substantially but not completely filling said container with said gassy liquid, inserting a volumetric member into said opening, said volumetric member having a thimble-like shape and having at least two openings extending through the walls thereof, one above the other, said lower opening being at least substantially twice the size of the upper opening, said volumetric member also having at least one channel extending along its side from the upper opening to substantially the bottom of the member, said channel being of a depth sufficient to prevent meniscus formation between said volumetric member and the side wall of the container into which said volumetric member is inserted, and sealing said container with a cap.

5. In combination, a fragile container having an opening and substantially but incompletely filled with a gassy liquid and a closure for said container sealing said container, said closure comprising a cap portion and a hollow volumetric member capable of containing gas within it under pressure, said volumetric member extending into the opening of said container and substantially filling that portion of the container not filled with said gassy liquid, said volumetric member having at least two openings therein providing open communication between the interior of the volumetric member and the interior of the container, one of said openings being spaced above the other of said openings, the lower of said openings being larger than the upper of said openings, whereby liquid contained within the member may drain therefrom and gas contained therein is not instantaneously released therefrom upon fracture of the container, said combination also including means to prevent formation of a meniscus of the gassy liquid between the side wall of the volumetric member and the adjacent wall of the container between said upper and lower openings.

6. The combination of claim 5 wherein one opening in the volumetric member is at the top of the volumetric member and the other is at the bottom.

7. The combination of claim 6 where the lower opening is at least twice the size of the upper opening.

8. The combination of claim 7 where the lower opening is from twice to ten times the size of the upper opening.

9. The combination of claim 6 where said means comprises a suitable space, at least at some point on the circumference of the side wall of the volumetric member and the adjacent wall of the container whereby a meniscus of the gassy liquid cannot form.

10. The combination of claim 6 wherein said means for preventing meniscus formation is at least one extending channel from the upper opening in the volumetric member to substantially the bottom thereof.

11. The combination of claim 10 where said means comprise four channels.

12. The combination of claim 7 including means whereby gas collected within the volumetric member is prevented from propelling said cap from said container.

13. The combination of claim 12 where said means comprises inseparably joining said volumetric member to said cap.

14. The combination of claim 12 where said means comprises inseparably a gas barrier layer between the volumetric member and the cap.

15. The combination of claim 7 including a flange around the upper surface of the volumetric member.

* * * * *